US007340192B2

(12) United States Patent
Kinouchi et al.

(10) Patent No.: US 7,340,192 B2
(45) Date of Patent: Mar. 4, 2008

(54) FIXING DEVICE OF IMAGE FORMING APPARATUS

(75) Inventors: Satoshi Kinouchi, Tokyo (JP); Osamu Takagi, Tokyo (JP); Yoshinori Tsueda, Shizuoka-ken (JP); Toshihiro Sone, Kanagawa-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 114 days.

(21) Appl. No.: 11/080,942

(22) Filed: Mar. 16, 2005

(65) Prior Publication Data

US 2006/0210292 A1 Sep. 21, 2006

(51) Int. Cl.

| | |
|---|---|
| ***G03G 15/20*** | (2006.01) |
| ***H05B 1/00*** | (2006.01) |
| ***H05B 3/00*** | (2006.01) |
| ***H05B 11/00*** | (2006.01) |

(52) U.S. Cl. ..... 399/69; 399/330; 219/216

(58) Field of Classification Search ..... 399/69, 399/328, 330–334; 219/216

See application file for complete search history.

(56) References Cited

U.S. PATENT DOCUMENTS

| | | | |
|---|---|---|---|
| 6,026,273 | A | 2/2000 | Kinouchi et al. |
| 6,078,781 | A | 6/2000 | Takagi et al. |
| 6,087,641 | A | 7/2000 | Kinouchi et al. |
| 6,097,926 | A | 8/2000 | Takagi et al. |
| 6,137,985 | A | 10/2000 | Kinouchi et al. |
| 6,154,629 | A | 11/2000 | Kinouchi et al. |
| 6,337,969 | B1 | 1/2002 | Takagi et al. |
| 6,415,128 | B1 | 7/2002 | Takagi et al. |
| 6,438,335 | B1 | 8/2002 | Kinouchi et al. |
| 6,643,476 | B1 | 11/2003 | Kinouchi et al. |
| 6,643,491 | B2 | 11/2003 | Kinouchi et al. |
| 6,724,999 | B2 | 4/2004 | Kikuchi et al. |
| 6,725,000 | B2 | 4/2004 | Takagi et al. |

(Continued)

FOREIGN PATENT DOCUMENTS

| | | |
|---|---|---|
| JP | 2002-082549 A | 3/2002 |

(Continued)

OTHER PUBLICATIONS

U.S. Appl. No. 10/945,395, filed Sep. 21, 2004, Kinouchi et al.

(Continued)

*Primary Examiner*—David M. Gray
*Assistant Examiner*—Joseph S. Wong
(74) *Attorney, Agent, or Firm*—Foley & Lardner LLP

(57) ABSTRACT

A fixing apparatus of an image forming apparatus of the present invention, in arrival timing of a temperature falling area of a heat roller passing a nip at opposite position γ of an induction heating coil from temperature detection position β by an infrared temperature sensor around the heat roller, according to detection results by the infrared temperature sensor, controls an output value of the induction heating coil under control of an inverter circuit, heats and returns the heat roller in real time to a fixable temperature, and realizes energy conversation. At the time of arrival at the nip, the heat controller is always set to a fixed fixable temperature, thus in a fixed image, a high image quality free of ripple marks can be obtained.

5 Claims, 8 Drawing Sheets

U.S. PATENT DOCUMENTS

| | | | | |
|---|---|---|---|---|
| 6,763,206 | B2 | 7/2004 | Kinouchi et al. | |
| 6,861,627 | B2 | 3/2005 | Wasai et al. | |
| 6,861,630 | B2 | 3/2005 | Kinouchi et al. | |
| 6,868,249 | B2 | 3/2005 | Kinouchi et al. | |
| 6,871,041 | B2 | 3/2005 | Takagi et al. | |
| 6,889,018 | B2 | 5/2005 | Kinouchi et al. | |
| 6,898,409 | B2 | 5/2005 | Tsueda et al. | |
| 6,900,419 | B2 | 5/2005 | Takagi et al. | |
| 7,049,562 | B2 * | 5/2006 | Tanino et al. | 399/69 |
| 2003/0113143 | A1 * | 6/2003 | Maeda et al. | 399/328 |
| 2004/0238531 | A1 | 12/2004 | Kikuchi et al. | |
| 2004/0265021 | A1 | 12/2004 | Kinouchi et al. | |
| 2005/0008413 | A1 | 1/2005 | Takagi et al. | |

FOREIGN PATENT DOCUMENTS

| | | | |
|---|---|---|---|
| JP | 2003-035601 | A | 2/2003 |

OTHER PUBLICATIONS

U.S. Appl. No. 10/805,514, filed Mar. 22, 2004, Kinouchi et al.
U.S. Appl. No. 10/944,707, filed Sep. 21, 2004, Sone et al.
U.S. Appl. No. 10/944,855, filed Sep. 21, 2004, Sone et al.
U.S. Appl. No. 10/820,138, filed Apr. 8, 2004, Sone et al.
U.S. Appl. No. 10/805,305, filed Mar. 22, 2004, Sone et al.
U.S. Appl. No. 10/805,420, filed Mar. 22, 2004, Sone et al.
U.S. Appl. No. 10/799,770, filed Mar. 15, 2004, Kikuchi et al.
U.S. Appl. No. 10/805,507, filed Mar. 22, 2004, Kikuchi et al.
U.S. Appl. No. 10/805,522, filed Mar. 22, 2004, Kikuchi et al.
U.S. Appl. No. 10/806,392, filed Mar. 23, 2004, Takagi et al.
U.S. Appl. No. 10/805,308, filed Mar. 22, 2004, Tsueda et al.
U.S. Appl. No. 10/378,859, filed Mar. 5, 2003, Sone et al.
U.S. Appl. No. 11/078,421, filed Mar. 14, 2005, Takagi et al.
U.S. Appl. No. 11/078,725, filed Mar. 14, 2005, Takagi et al.
U.S. Appl. No. 11/080,833, filed Mar. 16, 2005, Tsueda et al.
U.S. Appl. No. 11/078,726, filed Mar. 14, 2005, Tsueda et al.
U.S. Appl. No. 11/082,218, filed Mar. 17, 2005, Tsueda et al.
U.S. Appl. No. 11/080,909, filed Mar. 16, 2005, Kinouchi et al.

* cited by examiner

FIXING DEVICE OF IMAGE FORMING APPARATUS

FIELD OF THE INVENTION

The present invention relates to a fixing apparatus of an image forming apparatus loaded in the image forming apparatus such as a copier, a printer, or a facsimile for heating and fixing a toner image onto a sheet of paper using induction heating.

BACKGROUND OF THE INVENTION

As a fixing apparatus used in an image forming apparatus such as an electro-photographic copier or printer, there is a fixing apparatus for inserting a sheet of paper through a nip formed between a pair of rollers composed of a heat roller and a pressure roller or between similar belts and heating, pressurizing, and fixing a toner image. As such a heating type fixing apparatus, conventionally, there is an apparatus for heating a metallic conductive layer on the surface of a heat roller or a heating belt by the induction heating method. The induction heating method supplies predetermined power to an induction heating coil to generate a magnetic field, instantaneously heats the metallic conductive layer by an eddy current generated in the metallic conductive layer by the magnetic field, and heats the heat roller or heating belt.

In such a fixing apparatus of the induction heating method, for temperature control of the heat roller or fixing belt, as an apparatus for detecting the temperature without causing damage to the surface thereof, for example, in Japanese Patent Application Publication 2002-82549, an apparatus for arranging a temperature sensor on the inner peripheral surface of the fixing belt and controlling the temperature is disclosed.

However, this conventional temperature sensor is installed on the downstream side of the nip of the fixing belt and on the downstream side of an exciting coil. As a result, the real-time control of detecting the fallen temperature of the fixing belt at the time of fixing and before a sheet of paper reaches the nip next, heating and returning to a predetermined temperature cannot be executed. Further, the temperature sensor detects the temperature inside the fixing belt, so that there is a fear that an error may be caused between the detected result and the temperatures on both fixing sides.

Further, in Japanese Patent Application Publication 2003-35601, an apparatus for detecting the temperature on the surface side of an intermediate transfer belt generating heat by an exciting coil by a non-contact temperature detector is disclosed.

However, the non-contact temperature detector detects the temperature of the transfer belt reaching the exciting coil position and does not control the fallen temperature of the transfer belt at the time of fixing in real time before the next fixing time.

On the other hand, in recent years, a fixing apparatus of an induction heating method, a fixing apparatus for installing a thinned metallic conductive layer having a small heat capacity on the surface of a heat roller to realize faster heating of the metallic conductive layer and realizing more energy conservation has been developed. Such a heat roller having a thinned metallic conductive layer with a small heat capacity shows a greatly fallen temperature due to the fixing operation. Therefore, after passing the nip, before the same position of the heat roller next reaches the nip, unless the fallen temperature is recovered immediately by heating, the next fixing temperature at the same position of the heat roller is not sufficient. When the heating of replenishing the fallen temperature due to fixing is not in time, the difference in the surface temperature of the heat roller appears in a fixed image, and on the same image, temperature ripple marks different in gloss are caused, and the image quality is deteriorated.

Therefore, in the fixing apparatus having the installed thinned metallic conductive layer, development of a fixing apparatus of an image forming apparatus for immediately heating the heat roller after passing the nip, before the same position of the heat roller next reaches the nip, controlling the induction heating coil in real time so as to return the heat roller to the predetermined fixing temperature, having an excellent fixing property, and obtaining a high image quality is desired.

SUMMARY OF THE INVENTION

An object of the embodiments of the present invention is, in a fixing apparatus for heating a metallic conductive layer by an induction heating coil, although a heat roller falls in temperature due to fixing, before the heat roller next reaches a nip, to heat the heat roller up to a fixable temperature, improve the fixing property so as to eliminate generation of temperature ripple marks on a fixed image, and obtain a high image quality.

According to the embodiments of the present invention, there is provided a fixing apparatus of the image forming apparatus comprising an endless heating member having a metallic conductive layer; a pressure member pressed to the heating member to form a nip to hold and convey a medium to be fixed having a toner image in a predetermined direction together with the heating member; an induction heating coil arranged on an outer periphery of the heating member to generate an induced current in the metallic conductive layer; a temperature sensor for detecting a temperature of a passing area of the heating member through the nip; and a controller to control the induction heating coil so as to return the heating member to a predetermined temperature before the nip passing area of the heating member next reaches the nip.

DETAILED DESCRIPTION OF THE INVENTION

Figure 1:
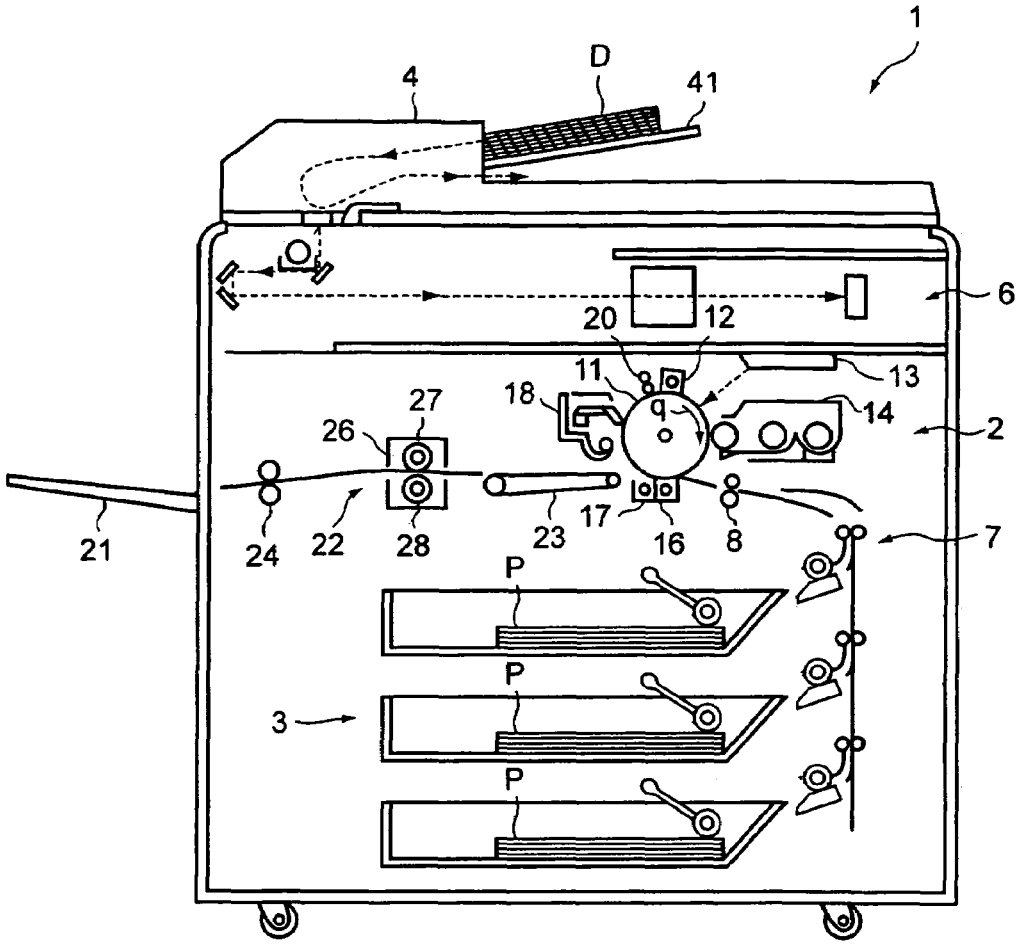
FIG. 1 is a schematic block diagram showing the image forming apparatus of the first embodiment of the present invention.

Hereinafter, the embodiments of the present invention will be explained in detail with reference to the accompanying drawings. FIG. 1 is a schematic block diagram showing image forming apparatus 1 loading fixing apparatus 26 of the embodiments of the present invention. Image forming apparatus 1 has cassette mechanism 3 for feeding sheets of paper P, which are fixed media, to image forming unit 2 and has scanner section 6 for reading documents D fed by automatic document feeder 4 on the top thereof. On conveyor path 7 from cassette mechanism 3 to image forming unit 2, register rollers 8 are installed. This side of register rollers 8, position sensor 9 for detecting passing of sheets of paper P is installed.

Image forming unit 2 includes, around photosensitive drum 11, charger 12 for uniformly charging photosensitive drum 11 sequentially according to the rotational direction of arrow q of photosensitive drum 11, laser exposure apparatus 13 for forming latent images on charged photosensitive drum 11 on the basis of image data from scanner 6, developing apparatus 14, transfer charger 16, separation charger 17, cleaner 18, and discharging LED 20. Image forming unit 2 forms toner images on photosensitive drum 11 by the known image forming process by the electro-photographic method and transfers them onto sheets of paper P.

On the downstream side of image forming unit 2 in the conveying direction of sheets of paper P, ejection paper conveyor path 22 for conveying sheets of paper P on which toner images are transferred toward paper ejection section 21 is installed. On ejection paper conveyor path 22, conveyor belt 23 for conveying sheets of paper P separated from photosensitive drum 11 to fixing apparatus 26 and paper ejection rollers 24 for ejecting sheets of paper P after passing fixing apparatus 26 to paper ejection section 21 are installed.

Figure 2:
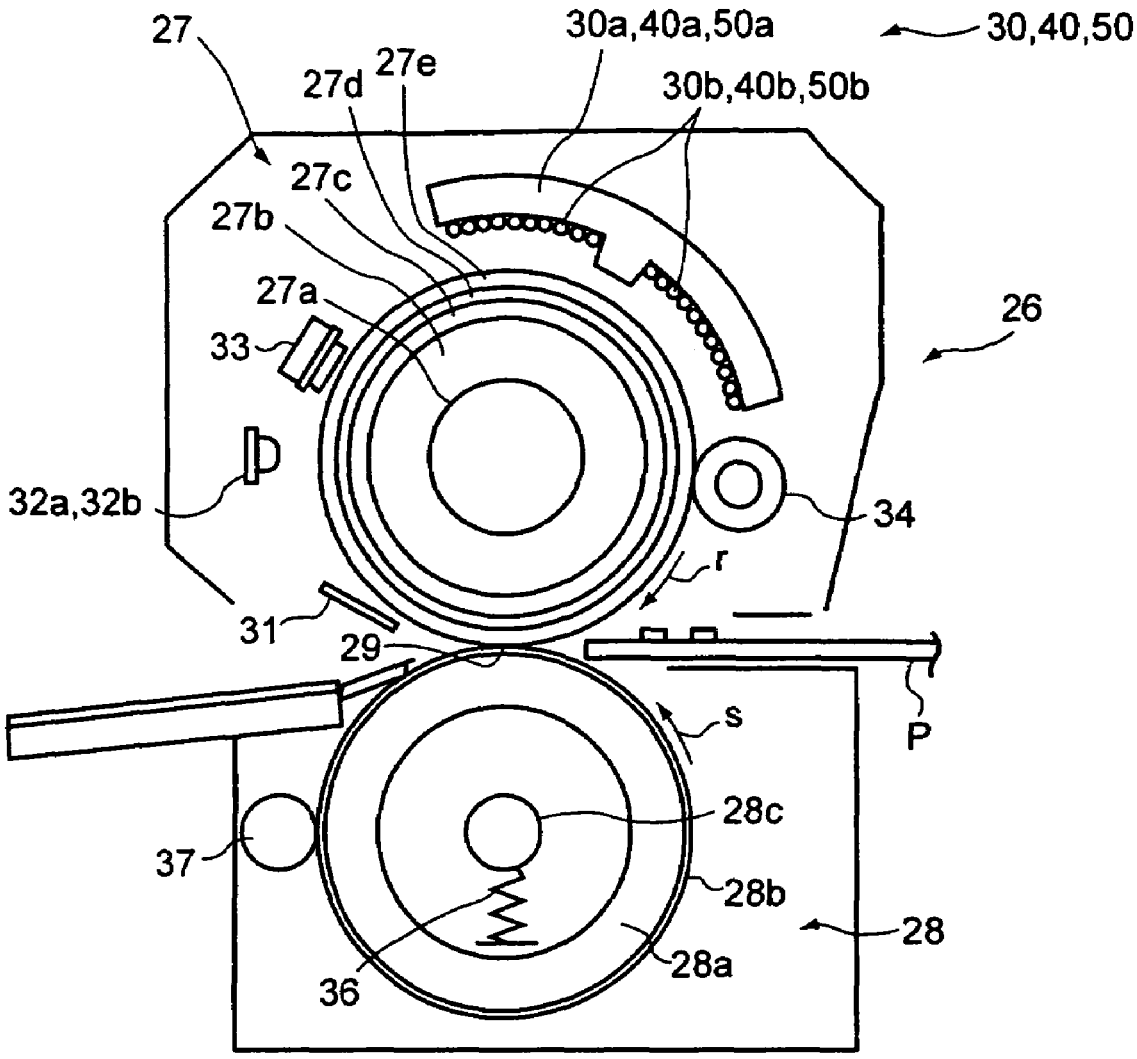
FIG. 2 is a schematic block diagram showing the fixing apparatus of the first embodiment of the present invention.
Figure 3:
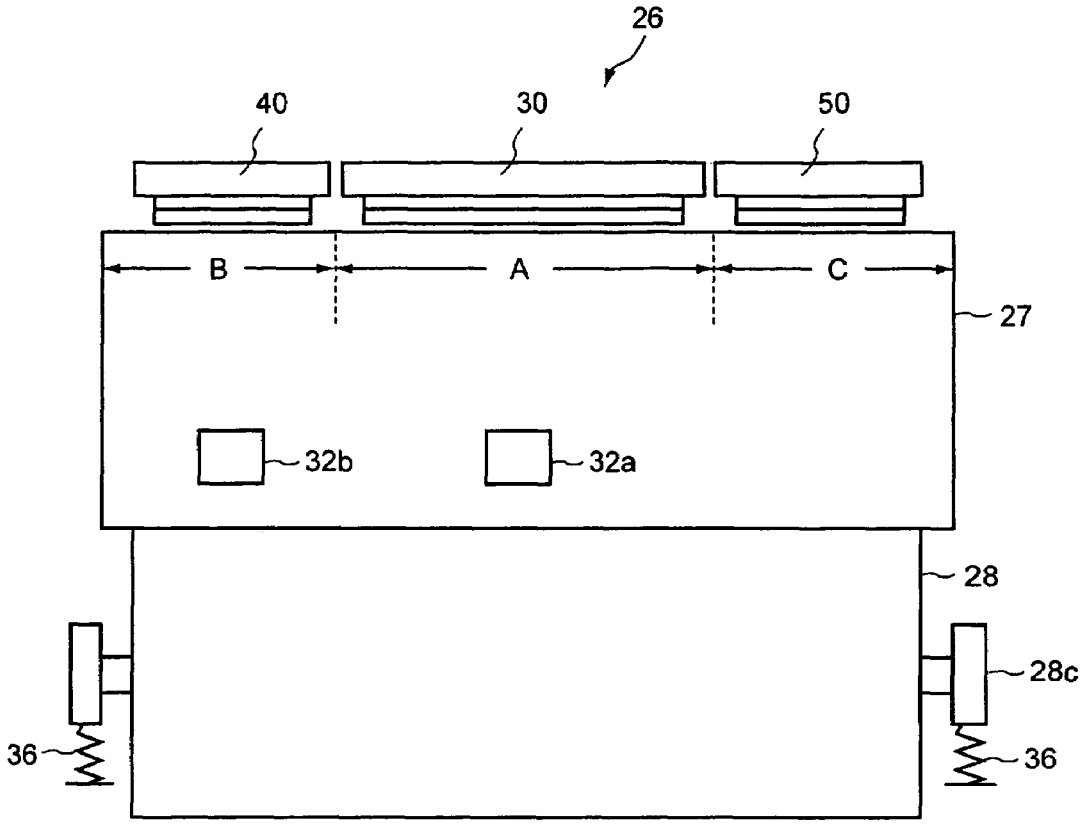
FIG. 3 is a schematic side view showing the fixing apparatus of the first embodiment of the present invention.
Figure 4:
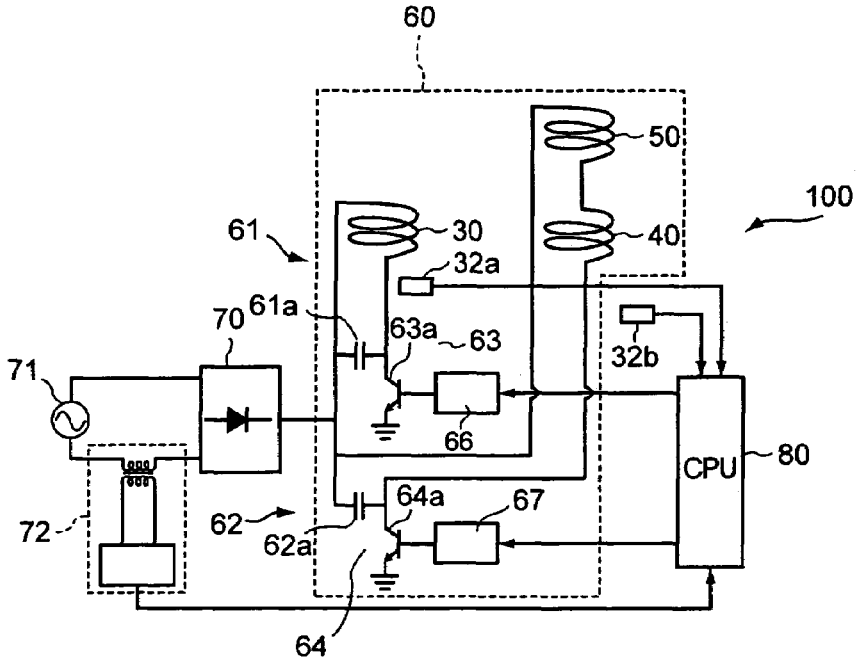
FIG. 4 is a schematic block diagram showing the heating control system of the heat roller of the first embodiment of the present invention.

Next, fixing apparatus 26 will be described. FIG. 2 is a schematic block diagram showing fixing apparatus 26, and FIG. 3 is a schematic side view showing fixing apparatus 26, and FIG. 4 is a block diagram showing control system 100 for heating heat roller 27. Fixing apparatus 26 has heat roller 27 which is an endless member and pressure roller 28 which is a pressure member pressed to heat roller 27. Furthermore, fixing apparatus 26 has induction heating coils 30, 40, and 50 which are an induced current generation means for a 100-V power source for heating heat roller 27 via a gap of about 3 mm on the outer periphery of heat roller 27. Induction heating coils 30, 40, and 50 are in an almost coaxial shape with heat roller 27.

Furthermore, on the outer periphery of heat roller 27, in the rotational direction of arrow r of heat roller 27, separation pawl 31 for preventing sheets of paper P after fixing from wrapping, infrared temperature sensors 32*a* and 32*b* of a thermopile type for detecting the surface temperature of heat roller 27 in non-contact, thermostat 33 for detecting an abnormal surface temperature of heat roller 27 and interrupting heating, and a cleaning roller 34 are installed. In heat roller 27, around core bar 27*a*, expanded rubber 27*b* with a thickness of 5 mm, metallic conductive layer 27*c*, made of nickel (Ni), with a thickness of 40 μm, solid rubber layer 27*d* with a thickness of 200 μm, and release layer 27*e* with a thickness of 30 μm are sequentially formed to a diameter of 40 mm. Solid rubber layer 27*d* and release layer 27*e* form a protective layer.

Pressure roller 28 is composed of core shaft 28*a* around which surface layer 28*b* such as silicone rubber or fluorine rubber is coated in a diameter of 40 mm. Pressure roller 28, since shaft 28*c* is pressed by pressure spring 36, is pressed to heat roller 27. By doing this, between heat roller 27 and pressure roller 28, nip 29 with a fixed width is formed. Further, around pressure roller 28, separation pawl 38 for separating sheets of paper P from pressure roller 28 in the rotational direction of arrow s and cleaning roller 37 are installed.

Induction heating coils 30, 40, and 50 are respectively supplied with a driving current, generate a magnetic field, generate an eddy current in metallic conductive layer 27*c* by this magnetic field, and heat metallic conductive layer 27*c*. Induction heating coils 30, 40, and 50 respectively heat areas A, B, and C of heat roller 27 in the longitudinal direction. Induction heating coils 30, 40, and 50 have the same structure though they are different in length. Induction heating coils 30, 40, and 50 are composed of magnetic material cores 30*a*, 40*a*, and 50*a* around which electric wires 30*b*, 40*b*, and 50*b* are wound 12 turns.

Induction heating coils 30, 40, and 50 are shaped so as to use magnetic material cores 30*a*, 40*a*, and 50*a*, so that the number of turns of magnetic material cores 30*a*, 40*a*, and 50*a* is reduced, thus they can be miniaturized. Further, induction heating coils 30, 40, and 50 are shaped so as to use magnetic material cores 30*a*, 40*a*, and 50*a*, so that the magnetic flux can be centralized and heat roller 27 can be heated locally.

Electric wires 30*b*, 40*b*, and 50*b* using heat resistant polyamide-imide copper wires are composed of a litz wire of 16 bundled copper wires with a wire diameter of 0.5 mm. Electric wires 30*b*, 40*b*, and 50*b* are formed as a litz wire, so that the copper loss of electric wires 30*b*, 40*b*, and 50*b* can be suppressed and an AC current can flow effectively.

Induction heating coils 40 and 50 for heating areas B and C on both sides of heat roller 27 are connected in series and are driven under the same control. According to a case of fixing large sheets of paper such as horizontal size A4 or A3 or a case of fixing vertical size A4 or other sheets of paper of small size, the driving ratio of induction heating coils 30, 40, and 50 is controlled, thus the temperature distribution of heat roller 27 in the longitudinal direction is made uniform.

Next, control system 100 for heating heat roller 27 will be described. As shown in the block diagram in FIG. 4, control system 100 for heating heat roller 27 has inverter circuit 60 for supplying a driving current to induction heating coils 30, 40, and 50, rectifier circuit 70 for supplying a DC supply voltage of 100 V to inverter circuit 60, and CPU 80 for controlling whole image forming apparatus 1, inputting detection results of sheets of paper P by position sensor 9, and controlling inverter circuit 60 according to detection results of infrared temperature sensors 32*a* and 32*b*. CPU 80, according to the detection results of infrared temperature sensors 32*a* and 32*b*, may drive so as to output induction heating coil 30 or only either of induction heating coils 40 and 50 and may drive simultaneously induction heating coil 30 and both induction heating coils 40 and 50.

Rectifier circuit 70 is for 100 V and rectifies a current from commercial AC power source 71 to a direct current at 100 V and supplies it to inverter circuit 60. Between rectifier circuit 70 and commercial AC power source 71, power monitor 72 is connected, detects power supplied from commercial AC power source 71, and feeds it back to CPU 80.

Inverter circuit 60 uses a self excitation type semi-E class circuit. To induction heating coil 30 of inverter circuit 60, first capacitor 61*a* for resonance is connected in parallel to form first resonance circuit 61 and to induction heating coils 40 and 50 connected in series, second capacitor 62*a* for resonance is connected in parallel to form second resonance circuit 62. To first resonance circuit 61, first switching element 63*a* is connected in series to form first inverter circuit 63 and to second resonance circuit 62, second switching element 64*a* is connected in series to form second inverter circuit 64. Switching elements 63*a* and 64*a* use an IGBT usable at a high breakdown voltage and a large current. Switching elements 63*a* and 64*a* may be a MOSFET.

To the control terminals of switching elements 63*a* and 64*a*, IGBT driving circuits 66 and 67 for turning on switching elements 63*a* and 64*a* are respectively connected. CPU 80 controls the application timing of IGBT driving circuits 66 and 67. Inverter circuit 60 controls the ON time of switching elements 63*a* and 64*a* by CPU 80, thereby converts the frequency to 20 to 60 kHz. For induction heating coils 30, 40, and 50, the power value is controlled according to a frequency of 20 to 60 kHz of the drive current and by the power value of induction heating coils 30, 40, and 50, the heat value of metallic conductive layer 27*c* is varied, and heat roller 27 is controlled in temperature.

Induction heating coils 30, 40, and 50 have a power value of 1100 W at the start time of fixing and warm up heat roller 27 to 160° C. which is a predetermined fixable temperature. The heat capacity of metallic conductive layer 27*c* of heat roller 27 is small, so that heat roller 27 is warmed up in about 40 seconds. On the other hand, the heat capacity of metallic conductive layer 27*c* is small, so that after passing the and being fixed, the surface temperature of heat roller 27 falls at least by 5° C. to 10° C. or so.

Induction heating coils 30, 40, and 50 heat roller 27 according to the temperature falling degree of heat roller 27. The power value of induction heating coils 30, 40, and 50 for heating heat roller 27, when heating heat roller 27 by 10° C. or higher, is set to 900 W, and when heating heat roller 27 by 5° C. to 10° C., is set to 600 W, and when heating heat roller 27 by lower than 5° C., is set to 400 W.

Figure 5:
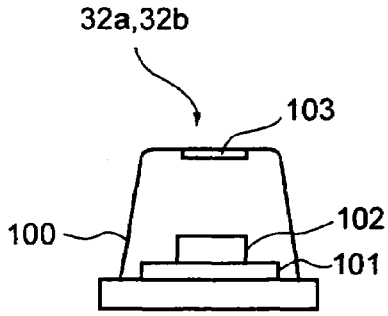
FIG. 5 is a schematic illustration showing the infrared temperature sensor of the first embodiment of the present invention.

Next, infrared temperature sensors 32*a* and 32*b*, as shown in FIG. 5, have thermopile 102 composed of many thin-film thermocouples made of polysilicone and aluminum connected in series on silicone substrate 101 installed in housing 100. Housing 100 has silicone lens 103 and focuses infrared light from heat roller 27 to thermopile 102. Temperature changes of the temperature contact generated on thermopile 102 due to reception of infrared light are output to CPU 80 as start power of the thermocouple.

Infrared temperature sensors 32*a* and 32*b* of a thermopile type are structured so as to make the heat capacity of the temperature contact of the thin-film thermocouple smaller, so that the temperature response is high. Infrared temperature sensors 32*a* and 32*b* of a thermopile type measure the temperature of an object in non-contact. Infrared temperature sensors 32*a* and 32*b* of a thermopile type have a response speed faster by about 20 times of that of a conventional temperature sensor of a non-contact thermistor type. The temperature sensor of a thermistor type outputs changes in the voltage applied to a metallic oxide whose resistance varies with temperature. CPU 80, according to detection results of infrared temperature sensors 32*a* and 32*b*, controls the frequency of a drive current of each of induction heating coils 30, 40, and 50 and controls the power value given to induction heating coils 30, 40, and 50.

Figure 6:
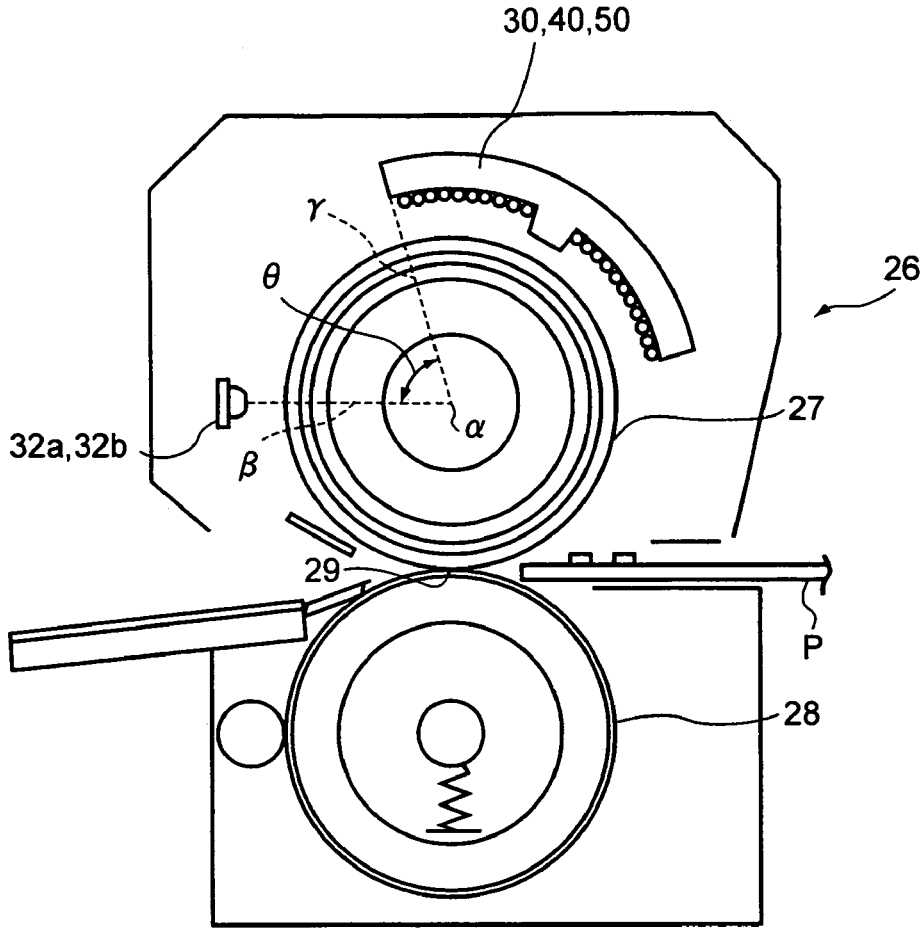
FIG. 6 is a schematic illustration showing arrangement of the infrared temperature sensor and induction heating coil around the heat roller of the first embodiment of the present invention.

Around heat roller 27, infrared temperature sensors 32*a* and 32*b*, as shown in FIG. 6, are arranged before heat roller 27 rotating in the direction of arrow r reaches induction heating coils 30 and 40 on the downstream side of nip 29 with pressure roller 28.

Arrangement position θ (°) from temperature detection position β by infrared temperature sensors 32*a* and 32*b* centering on shaft a of heat roller 27 around heat roller 27 to opposite position γ of the upstream side ends of induction heating coils 30 and 40 is indicated as follows:

$$\theta(°) > S1 \times t \times 360/(2\pi r)$$

S1 indicates a rotational speed of heat roller 27, and r indicates a radius of heat roller 27, and t indicates a response speed of infrared temperature sensors 32*a* and 32*b*. Further, temperature detection position β by infrared temperature sensors 32*a* and 32*b* around heat roller 27 is an intersection point between the extension of the center of the optical axis of silicone lens 103 of infrared temperature sensors 32*a* and 32*b* and heat roller 27. The optical axis of silicone lens 103 of infrared temperature sensors 32*a* and 32*b* can be set in an optional direction when necessary.

When infrared temperature sensors 32*a* and 32*b* are arranged around heat roller 27 as described above, they detect the temperature of heat roller 27 after passing nip 29 and according to detection results, can heat the nip passing position on heat roller 27 by induction heating coils 30, 40, and 50 in real time.

In this embodiment, assuming rotational speed S1 of heat roller 27 as 130 mm/sec and response time t of infrared temperature sensors 32*a* and 32*b* as 0.1 sec, since radius r of heat roller 27 is 20 mm, arrangement position θ(°) from temperature detection position β to opposite position y around heat roller 27 may be set as θ(°)>38 (°). However, in this embodiment, in consideration of the processing speed by CPU 80, infrared temperature sensors 32*a* and 32*b* are arranged so as to realize θ(°)=70(°). Here, rotational speed S1 of heat roller 27 is the same as the process speed of image forming unit 2.

Next, the operation of the invention will be described. When the image forming process starts, in image forming unit 2, photosensitive drum 11 rotating in the direction of arrow q is uniformly charged by charger 12 and is irradiated with a laser beam according to document information by laser exposure apparatus 13, thus an electrostatic latent image is formed. Next, the electrostatic latent image is developed by developing apparatus 14 and a toner image is formed on photosensitive drum 11.

The toner image on photosensitive drum 11 is transferred onto sheet of paper P by transfer charger 16. Next, sheet of paper P is separated from photosensitive drum 11, then is rotated in the direction of arrow r of fixing apparatus 26, and is inserted through nip 29 between heat roller 27 heated to 160° C. by induction heating coils 30, 40, and 50 and pressure roller 28 rotating in the direction of arrow s to heat, pressurize, and fix the toner image.

During fixing the toner image, in fixing apparatus 26, infrared temperature sensors 32*a* and 32*b* detect the fallen surface temperature of heat roller 27 after passing nip 29 and finishing fixing. CPU 80, by detection results from infrared temperature sensors 32*a* and 32*b*, according to the temperature difference between the surface temperature of heat roller 27 and the fixable temperature 160° C., controls the ON time of switching elements 63*a* and 64*a* of inverter circuit 60 and changes the frequency of a drive current to induction heating coils 30, 40, and 50. According to the frequency of the drive current, the power value of induction heating coils 30, 40, and 50 is controlled.

For example, when infrared temperature sensors 32*a* and 32*b* detect a surface temperature of 155° C. of heat roller 27, CPU 80 calculates a temperature difference of 5° C. from the fixable temperature 160° C. and controls inverter circuit 60 so as to output a power value of 600 W from induction heating coils 30, 40, and 50.

The time from detection of the surface temperature of heat roller 27 by infrared temperature sensors 32*a* and 32*b* to output of the power value of induction heating coils 30, 40, and 50 requires a response time of 0.1 s of infrared temperature sensors 32*a* and 32*b* and the processing speed of CPU 80.

However, arrangement position θ(°) from temperature detection position β by infrared temperature sensors 32*a* and 32*b* to opposite position $_Y$ of the upstream side ends of induction heating coils 30 and 40 is 70°. Therefore, before the area where heat roller 27 falls in temperature reaches induction heating coils 30, 40, and 50, induction heating coils 30, 40, and 50 can output sufficiently the power value and induction heating coils 30, 40, and 50, before the area where heat roller 27 falls in temperature next reaches nip 29, are heated and returned to the fixable temperature 160° C.

By doing this, the surface temperature of heat roller 27 in nip 29 is always heated to the fixable temperature 160° C. and a toner image formed on sheet of paper P is uniformly fixed without generating temperature ripple marks. Further, during fixing in this way, when the temperature difference between the detection temperature by infrared temperature sensors 32*a* and 32*b* and the fixable temperature 160° C. varies with changes in the thickness and material of sheets of paper P or environment, CPU 80 controls inverter circuit 60 according to the temperature difference, changes the output power value of induction heating coils 30, 40, and 50, and always controls the surface temperature of heat roller 27 in nip 29 to the fixable temperature 160° C.

After ending of the fixing, CPU 80, according to the detection temperature by infrared temperature sensors 32*a* and 32*b*, maintains and controls heat roller 27 to the fixable temperature 160° C. by the ON-OFF control of inverter circuit 60 and stands by for the next fixing operation.

According to this embodiment, infrared temperature sensors 32*a* and 32*b* for detecting the temperature of heat roller 27 are arranged so that arrangement position θ(°) centering on shaft α of heat roller 27 from temperature detection position γ by infrared temperature sensors 32*a* and 32*b* to opposite position γ of the upstream side ends of induction heating coils 30 and 40 is set to $\theta(°) > S1 \times t \times 360/(2\pi r)$. And, according to detection results of infrared temperature sensors 32*a* and 32*b*, induction heating coils 30, 40, and 50 are controlled by CPU 80, output a necessary power value before the area where heat roller 27 falls in temperature reaches induction heating coils 30, 40, and 50, and returns heat roller 27 to the fixable temperature.

Therefore, heat roller 27, even if it falls in temperature by the fixing operation at the position of nip 29, before it reaches next nip 29, is given a necessary heat value by induction heating coils 30, 40, and 50, returns to the fixable temperature in real time, and can execute satisfactory fixing.

Namely, metallic conductive layer 27*c* having a thin thickness such as 40 μm and a small heat capacity is instantaneously heated by induction heating coils 30, 40, and 50 excited by a power value necessary to replenish the fallen temperature caused by the fixing operation, and heat roller 27 is heated and returned to the fixable temperature 160° C. in real time, thus energy conservation of fixing apparatus 26 can be realized without consuming power unnecessarily. Further, regardless of changes in the thickness and material of sheets of paper P or environmental temperature, the surface temperature of heat roller 27 reaching nip 29 can be always set at the fixable temperature 160° C., and toner images can be fixed at a fixed temperature, and no ripple marks are formed on fixed images, and the image quality can be improved by a satisfactory fixing property.

Next, the second embodiment of the present invention will be explained. In the second embodiment, the heat roller in the first embodiment is changed to a fixing belt and the other is the same as that of the first embodiment. Therefore, in the second embodiment, to the same components as those of the first embodiment, the same numerals are assigned and the detailed explanation will be omitted.

Figure 7:
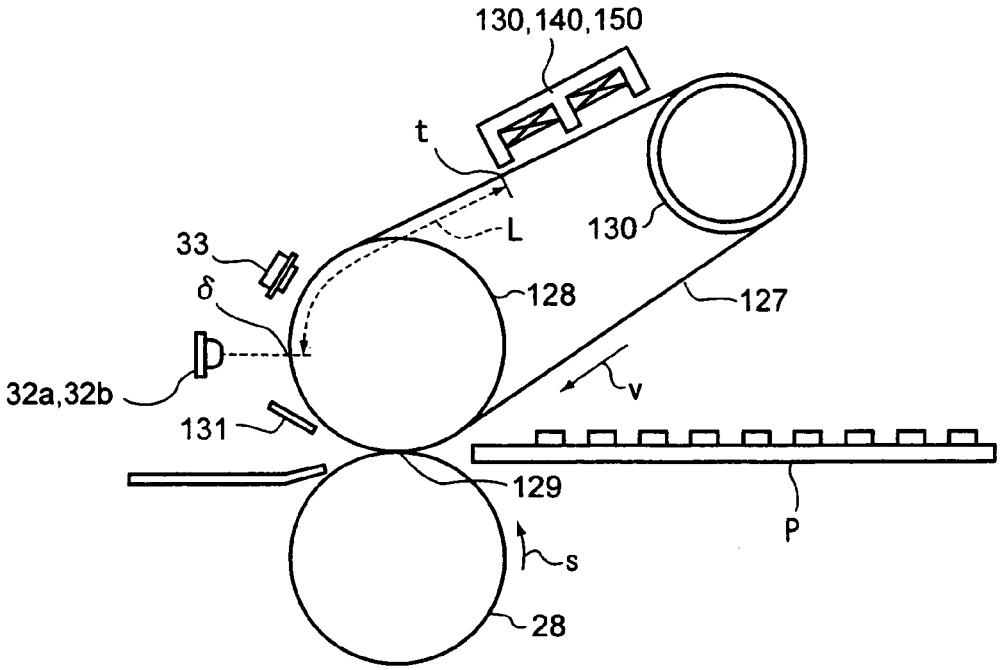
FIG. 7 is a schematic block diagram showing the fixing apparatus of the second embodiment of the present invention.

Fixing apparatus 126 shown in FIG. 7 in the second embodiment has fixing belt 127 with a peripheral length of 70×π (mm), which is an endless heating member, stretched between low-thermal conductivity roller 128 and backup roller 130. At the position of low-thermal conductivity roller 128, pressure roller 28 is pressed to fixing belt 127 and between fixing belt 127 and pressure roller 28, nip 129 with a fixed width is formed. In the rotational direction of arrow v of fixing belt 127, on the downstream side of nip 129, separation pawl 131 for preventing sheets of paper P after fixing from wrapping, infrared temperature sensors 32*a* and 32*b* of a thermopile type for detecting the surface temperature of heat roller 27 in non-contact, and thermostat 33 for detecting an abnormal surface temperature of fixing belt 127 and interrupting heating are installed.

Furthermore, on the downstream side of thermostat 33 of fixing belt 127, induction heating coils 130, 140, and 150 which are induced current generation means for a power source of 100 V for heating fixing belt 127 are installed via a gap of about 3 mm.

Figure 8:
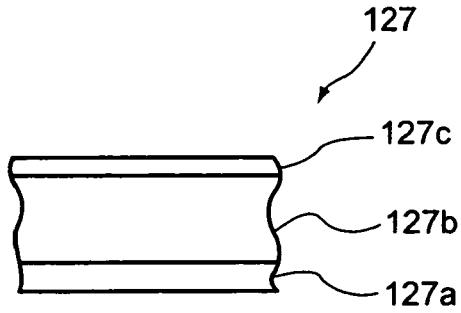
FIG. 8 is a schematic illustration showing the layer constitution of the fixing belt of the second embodiment of the present invention.

Fixing belt 127, as shown in FIG. 8, is a three-layer belt structured so that the surface of nickel (Ni) substrate 127*a* with a thickness of 40 μm is covered with elastic silicone rubber 127*b* in a thickness of 300 μm and moreover, to give a release property, is covered with release layer 127*c* made of fluorine plastics in a thickness of 30 λm. The base material of the fixing belt, if it is conductive, may be SUS or polyimide coated with a metallic layer.

Low thermal conductive roller 128 is a roller with a diameter of 30 mm having a surface of elastic expanded silicone sponge of low hardness. Backup roller 130 is made of ceramics with a diameter of 20 mm and a thickness of 0.5 mm. Backup roller 130 may be made of iron, SUS304, or aluminum.

Induction heating coils 130, 140, and 150 have the same structure as that of induction heating coils 30, 40, and 50 in the first embodiment except that magnetic material cores 30*a*, 40*a*, and 50*a* are arranged in a plane shape in parallel with the plane section of fixing belt 127.

Around fixing belt 127, distance L from temperature detection position δ by infrared temperature sensors 32*a* and 32*b* to opposite position ϵ of the upstream side ends of induction heating coils 130 and 140 is set to L>S2×t. S2 indicates a rotational speed of fixing belt 127 and t indicates a response speed of infrared temperature sensors 32*a* and 32*b*. Temperature detection position δ by infrared temperature sensors 32*a* and 32*b* around fixing belt 127 is an intersection point between the extension of the center of the optical axis of silicone lens 103 of infrared temperature sensors 32*a* and 32*b* and fixing belt 127.

In this embodiment, rotational speed S2 of fixing belt 127 is 130 mm/s and a response speed t of infrared temperature sensors 32*a* and 32*b* is 0.1 s, so that distance L from temperature detection position δ around fixing belt 127 to opposite position ϵ may be set to L>13 mm. However, actually, in consideration of the processing speed of CPU 80, infrared temperature sensors 32*a* and 32*b* are arranged so that L=30 mm is held.

When infrared temperature sensors 32*a* and 32*b* are arranged as mentioned above, they detect the temperature of fixing belt 127 after passing nip 129 and according to detection results, can heat the nip passing position on fixing belt 127 by induction heating coils 130, 140, and 150 in real time.

In this embodiment, image forming unit 2 forms a toner image on sheet of paper P and then inserts sheet of paper P through nip 129 between fixing belt 127 of fixing apparatus 126 and pressure roller 28 to heat, pressurize, and fix the toner image. During fixing the toner image, in fixing apparatus 126, infrared temperature sensors 32*a* and 32*b* detect the fallen surface temperature of fixing belt 127 after passing nip 29 and finishing fixing.

CPU 80, by detection results from infrared temperature sensors 32*a* and 32*b*, in the same way as with the first embodiment, according to the temperature difference between the surface temperature of fixing belt 127 and the fixable temperature 160° C., controls the ON time of switching elements 63*a* and 64*a* of inverter circuit 60, changes the output power value of induction heating coils 130, 140, and 150, and gives a necessary heat value to fixing belt 127. By doing this, when it reaches next nip 129, the surface temperature of fixing belt 127 is always heated and returned to the fixable temperature 160° C. Therefore, a toner image formed on sheet of paper P is uniformly fixed without generating temperature ripple marks.

The time from detection of the surface temperature of fixing belt 127 by infrared temperature sensors 32*a* and 32*b* to output of the power value of induction heating coils 130, 140, and 150 requires a response time of 0.1 second of infrared temperature sensors 32*a* and 32*b* and the processing speed of CPU 80. However, distance L from temperature detection position δ by infrared temperature sensors 32*a* and 32*b* to opposite position ϵ of the upstream side ends of induction heating coils 130 and 140 is 30 mm. Therefore, before the area where fixing belt 127 falls in temperature reaches induction heating coils 130, 140, and 150, induction heating coils 130, 140, and 150 can output surely.

Figure 9:
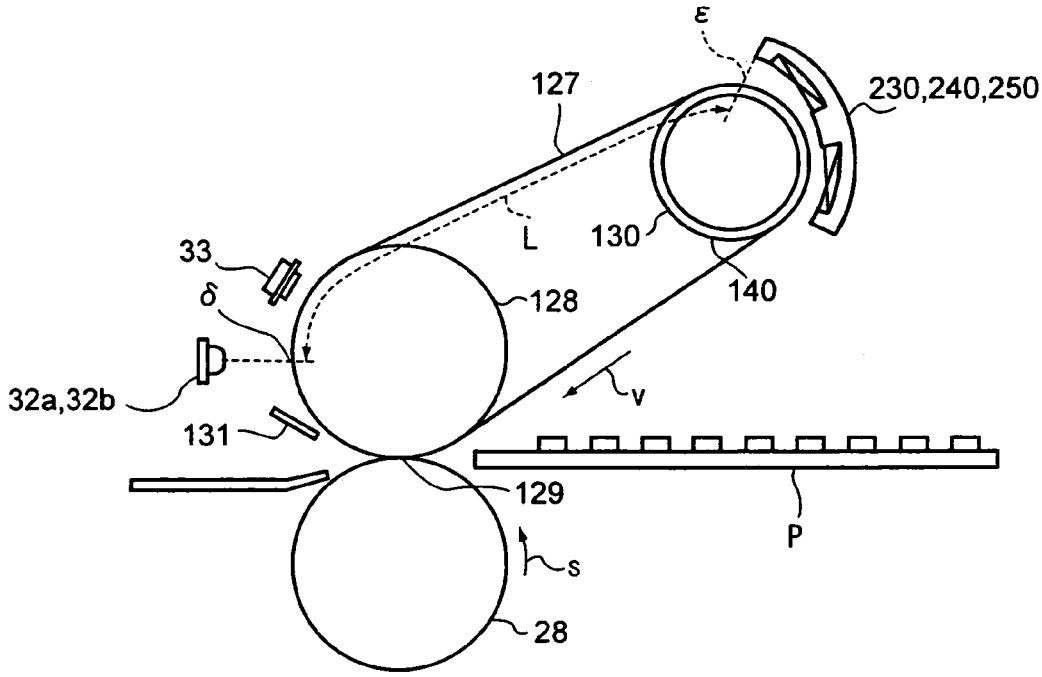
FIG. 9 is a schematic block diagram showing a modification of the fixing apparatus of the second embodiment of the present invention.

Further, in this embodiment, as shown in FIG. 9, it is possible to form backup roller 140 by a metallic material and position induction heating coils 230, 240, and 250 opposite to backup roller 140 to heat backup roller 140.

According to the second embodiment, infrared temperature sensors 32*a* and 32*b* for detecting the temperature of fixing belt 127 are arranged so that distance L from temperature detection position δ by infrared temperature sensors 32*a* and 32*b* to opposite position ϵ of the upstream side ends of induction heating coils 130 and 140 is set to L>S2 ×t and according to detection results of infrared temperature sensors 32*a* and 32*b*, induction heating coils 130, 140, and 150 output a predetermined power value before the area where fixing belt 127 falls in temperature reaches induction heating coils 130, 140, and 150.

Therefore, fixing belt 127, even if it falls in temperature by the fixing operation at the position of nip 129, before it reaches next nip 129, is given a necessary heat value by induction heating coils 130, 140, and 150, returns to the fixable temperature in real time, and can execute satisfactory fixing.

Namely, induction heating coils 130, 140, and 150 are excited by a power value necessary to replenish the fallen temperature caused by the fixing operation, and a nickel base material 127*c* having a thin thickness such as 40 μm and a small heat capacity is instantaneously heated, and fixing belt 127 is heated and returned to the fixable temperature 160° C. in real time, thus energy conservation of fixing apparatus 26 can be realized free of unnecessary power consumption. Further, regardless of changes in the thickness and material of sheets of paper P or environmental temperature, the surface temperature of fixing belt 127 reaching nip 129 can be always set at the fixable temperature 160° C., so that no ripple marks are formed on fixed images, and the image quality can be improved by a satisfactory fixing property.

Next, the third embodiment of the present invention will be explained. The third embodiment is different in the performance of the temperature sensor from the first embodiment and the other is the same as that of the first embodiment. Therefore, in the third embodiment, to the same components as those of the first embodiment, the same numerals are assigned and the detailed explanation will be omitted.

Figure 10:
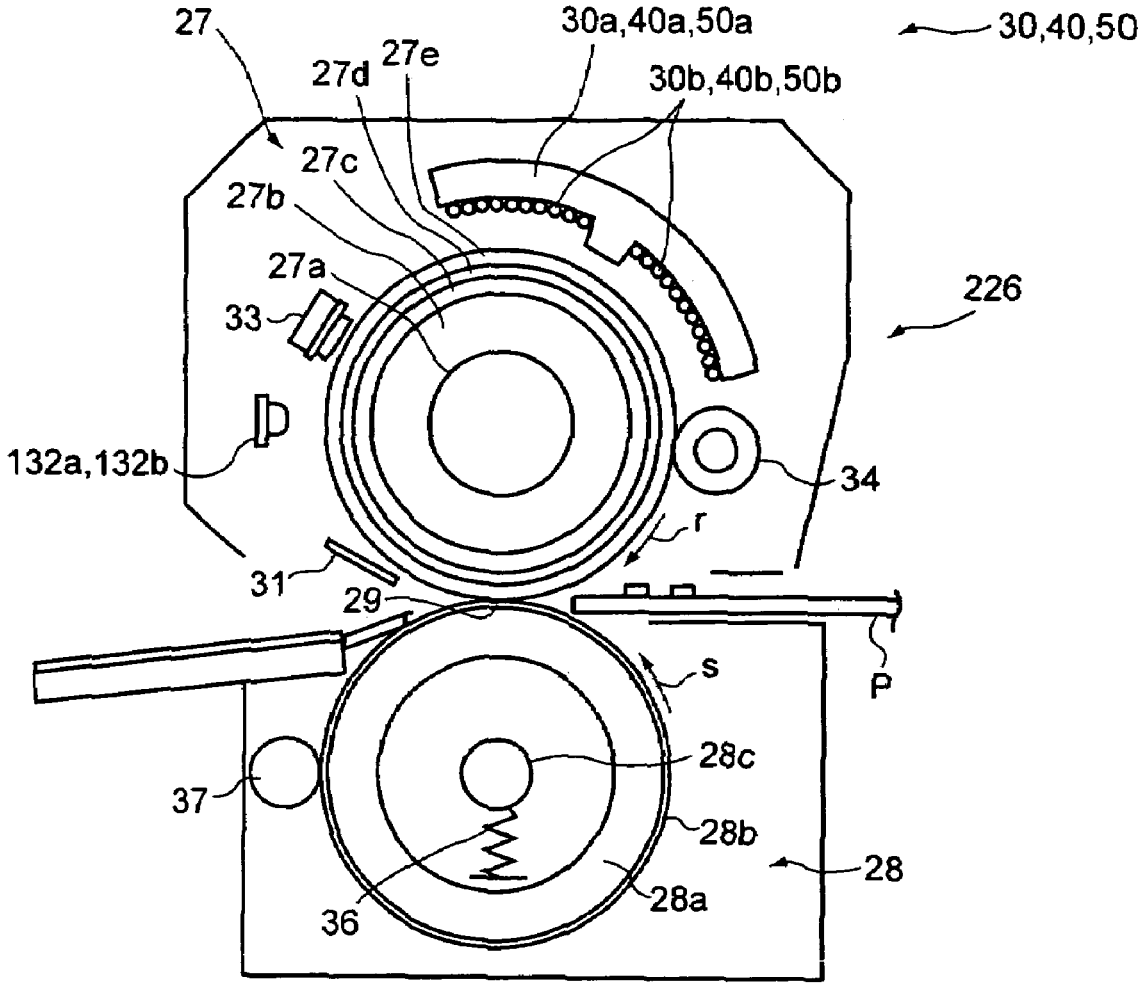
FIG. 10 is a schematic block diagram showing the fixing apparatus of the third embodiment of the present invention.

Fixing apparatus 226 of this embodiment, as shown in FIG. 10, uses, for example, temperature sensors 132*a* and 132*b* of a thermistor type which are low priced but not fast in the response speed compared with an infrared temperature sensor of a thermopile type fast in the response speed and detects the surface temperature of heat roller 27 after passing nip 29.

Figure 11:
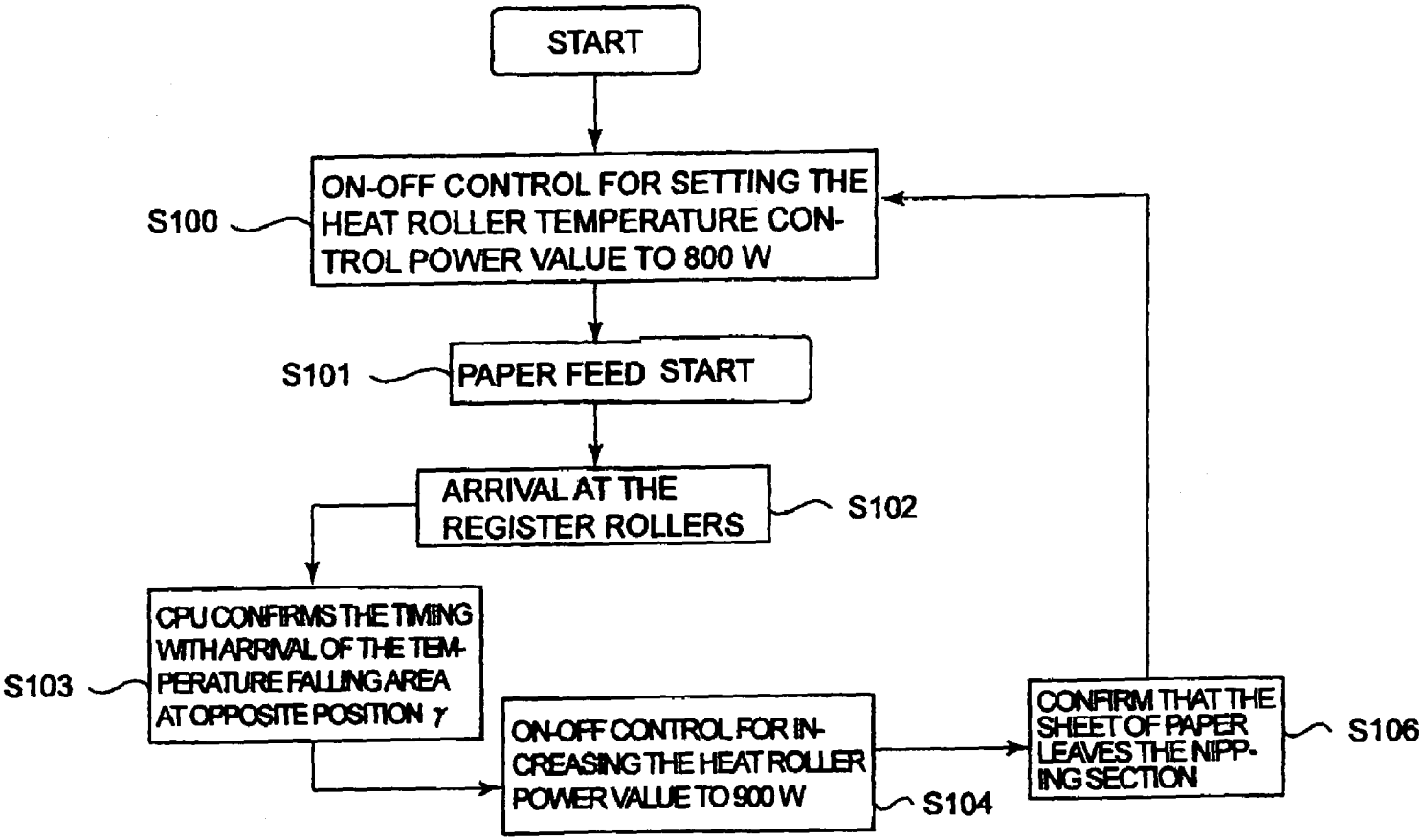
FIG. 11 is a flow chart showing temperature control of the fixing apparatus of the third embodiment of the present invention.

By referring to the flow chart shown in FIG. 11, the temperature control of heat roller 27 in fixing apparatus 226 will be described. After starting, at Step 100, according to detection results of temperature sensors 132*a* and 132*b*, CPU 80 sets the output power value of induction heating coils 30, 40, and 50 to 800 W, controls turning ON or OFF inverter circuit 60, and maintains and controls heat roller 27 to the fixable temperature 160° C. At Step 101, feed of sheets of paper P is started, and then at Step 102, position sensor 9 detects the front end of sheet of paper P, and detects that sheet of paper P reaches register rollers 8.

At Step 103, according to detection of the front end of sheet of paper P, CPU 80 confirms the arrival timing of the temperature falling area of heat roller 27 due to passing of sheet of paper P through nip 29 at opposite position $_Y$ of induction heating coils 30, 40, and 50. At Step 104, in the arrival timing of the temperature falling area of heat roller 27 at opposite position $_Y$, CPU 80 increases the output power value of induction heating coils 30, 40, and 50 to 900 W. Hereafter, before sheet of paper P passes nip 29, according to detection results of temperature sensors 132*a* and 132*b*, CPU 80 controls turning ON or OFF inverter circuit 60 and maintains and controls heat roller 27 to the fixable temperature 160° C. By doing this, a toner image is fixed in nip 29, and the area of heat roller 27 where the temperature lowers is heated and returned to the fixable temperature 160° C. and reaches again nip 29. Further, at this time, the power value supplied to induction heating coils 30, 40, and 50 can be adjusted optionally according to changes in the thickness and material of sheets of paper P or environmental temperature.

Hereafter, at Step 106, when CPU 80 confirms that sheet of paper P leaves nip 29, CPU 80 returns to Step 100, returns the output power value of induction heating coils 30, 40, and 50 to 800 W, and according to detection results of temperature sensors 132*a* and 132*b*, controls turning ON or OFF inverter circuit 60. Confirmation of sheet of paper P leaving nip 29 at Step 106 is executed by the size of sheet of paper P which is confirmed beforehand or the passing time of sheet of paper P detected by position sensor 9.

Namely, in this embodiment, during the fixing operation, CPU 80 confirms by position sensor 9 that sheet of paper P reaches nip 29, increases the power value of induction heating coils 30, 40, and 50, and controls the temperature of heat controller 27. By doing this, even if the response speed of temperature sensors 132*a* and 132*b* is not so high, CPU 80 prevents that the power value control for induction heating coils 30, 40, and 50 in real time according to detection results of temperature sensors 132*a* and 132*b* is not in time, thus when sheet of paper P reaches next nip 29, some temperature falling area remains on heat roller 27.

According to this embodiment, CPU 80 controls the temperature of heat roller 27 from detection results of temperature sensors 132*a* and 132*b* and when the fixing operation is started, confirms the arrival timing of the temperature falling area of heat roller 27 at induction heating coils 30, 40, and 50 using position sensor 9, increases the power value of induction heating coils 30, 40, and 50, and returns all the areas of heat roller 27 to the fixable temperature.

By doing this, heat roller 27 returns the temperature only of the temperature falling area caused by fixing start by a necessary power value by induction heating coils 30, 40, and 50. Therefore, unnecessary power consumption during the fixing operation is prevented and energy conservation of fixing apparatus 26 can be realized. Further, during the fixing operation, the surface temperature of heat roller 27 reaching nip 129 can be always kept at a fixed fixable temperature, so that the image quality can be improved by a satisfactory fixing capacity without generating ripple marks on a fixed image.

Next, the fourth embodiment of the present invention will be explained. The fourth embodiment is different in the control of the inverter circuit from the third embodiment and the other is the same as that of the third embodiment. Therefore, in the fourth embodiment, to the same components as those of the third embodiment, the same numerals are assigned and the detailed explanation will be omitted.

Figure 12:
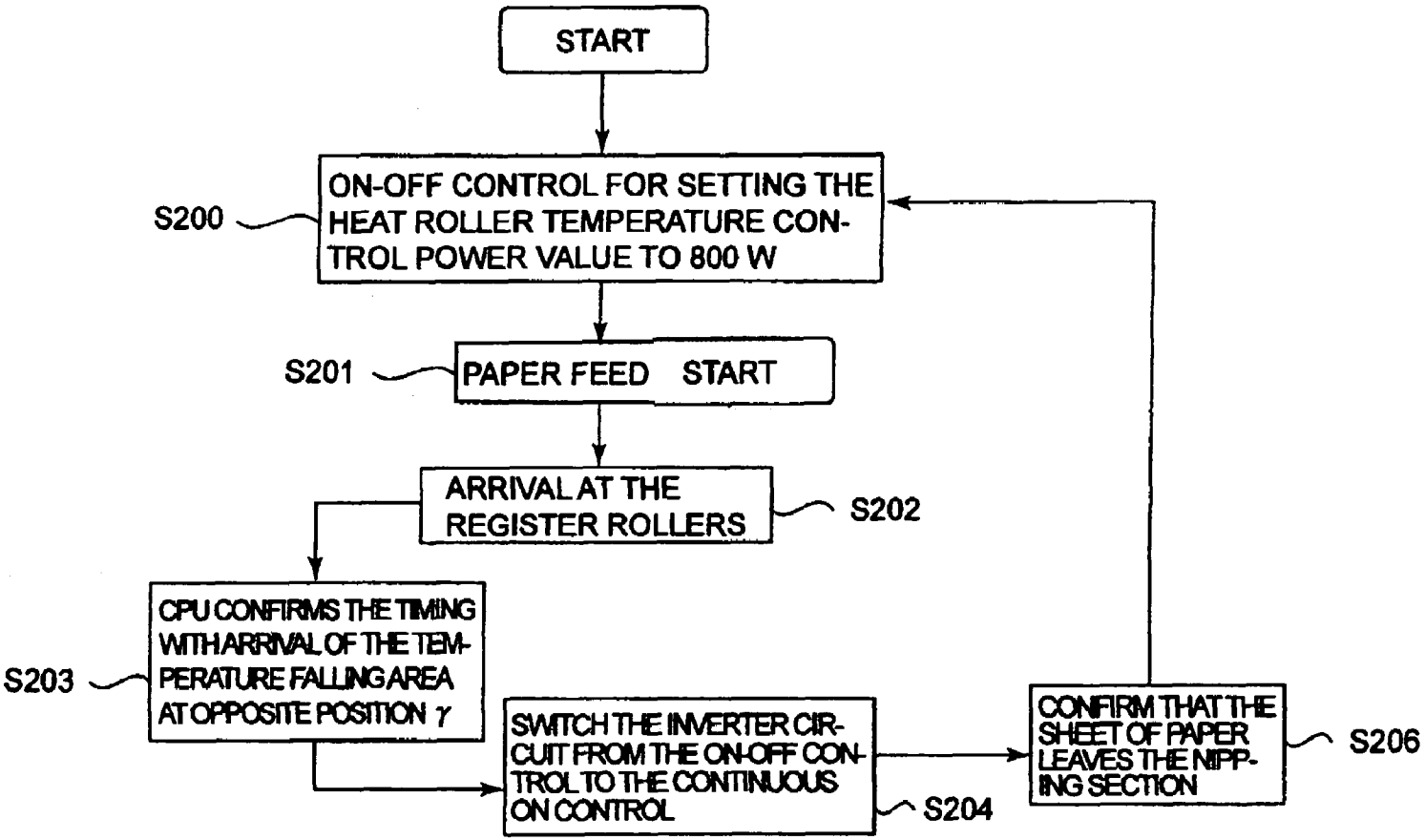
FIG. 12 is a flow chart showing temperature control of the fixing apparatus of the fourth embodiment of the present invention.

By referring to the flow chart shown in FIG. 12, the temperature control of heat roller 27 in fixing apparatus 226 will be described. After starting, at Step 200, according to detection results of temperature sensors 132*a* and 132*b*, CPU 80 sets the output power value of induction heating coils 30, 40, and 50 to 800 W, controls turning ON or OFF inverter circuit 60, and maintains and controls heat roller 27 to the fixable temperature 160° C. At Step 201, feed of sheets of paper P is started, and then at Step 202, position sensor 9 detects the front end of sheet of paper P, and detects that sheet of paper P reaches register rollers 8.

At Step 203, CPU 80 confirms the arrival timing of the temperature falling area of heat roller 27 due to passing of sheet of paper P through nip 29 at opposite position $_Y$ of induction heating coils 30, 40, and 50. At Step 204, in the arrival timing of the temperature falling area of heat roller 27 at opposite position $_Y$, CPU 80 switches the ON-OFF control of inverter circuit 60 according to detection results of temperature sensors 132*a* and 132*b* to the control of always keeping inverter circuit 60 ON. By doing this, a toner image is fixed in nip 29, and the area of heat roller 27 where the temperature lowers is always kept at a fixed fixable temperature by induction heating coils 30, 40, and 50, and reaches again nip 29. Further, at this time, the power value supplied to induction heating coils 30, 40, and 50 can be changed and adjusted optionally according to changes in the thickness and material of sheets of paper P or environmental temperature and when the power value under the continuous ON control of inverter circuit 60 is insufficient, for example, in a state that the power value of induction heating coils 30, 40, and 50 is increased to 850 W, the control of always keeping inverter circuit 60 ON can be switched to.

Hereafter, at Step 206, when CPU 80 confirms that sheet of paper P leaves nip 29, CPU 80 returns to Step 100 and returns the continuous ON control for inverter circuit 60 to the ON-OFF control according to detection results of temperature sensors 132*a* and 132*b*.

Confirmation of sheet of paper P leaving nip 29 at Step 206 is executed by the size of sheet of paper P which is confirmed beforehand or the passing time of sheet of paper P detected by position sensor 9.

Namely, in this embodiment, during the fixing operation, CPU 80 confirms by position sensor 9 that sheet of paper P reaches nip 29 and during passing of the temperature falling area of heat roller 27 through induction heating coils 30, 40, and 50, executes the continuous ON control for induction heating coils 30, 40, and 50. By doing this, even if the response speed of temperature sensors 132*a* and 132*b* is not so high and the power value control for induction heating coils 30, 40, and 50 in real time is not in time, during execution of the fixing operation, heat roller 27 is always heated with the same power value. Therefore, the surface temperature of heat roller 27 when heat roller 27 reaches nip 29 is always kept at a fixed fixable temperature.

According to this embodiment, CPU 80, in the ready state, controls the temperature of heat roller 27 according to detection results of temperature sensors 132*a* and 132*b*, during the fixing operation, confirms the arrival timing of the temperature falling area of heat roller 27 at induction heating coils 30, 40, and 50 using position sensor 9, during continuation of the fixing operation, keeps induction heating coils 30, 40, and 50 ON, and continuously retains heat roller 27 at a fixed fixable temperature. By doing this, CPU 80 can supply a necessary power value only to the area used for the fixing operation of heat roller 27, prevents unnecessary power consumption during the fixing operation, and can realize energy conservation of fixing apparatus 26. Further, during execution of the fixing operation, the surface temperature of heat roller 27 reaching nip 29 is always constant, so that the image quality can be improved by a satisfactory fixing capacity without generating ripple marks on a fixed image.

Further, the present invention is not limited to the aforementioned embodiments and within the scope of the present invention, can be modified variously and for example, the material of the metallic conductive layer may be unrestrictedly stainless steel, aluminum, or a composite material of stainless steel and aluminum.

Further, the thickness of the metallic conductive layer is not restricted and optional. However, to make the thermal capacity smaller, shorten the warming-up time, realize energy conservation, and exactly control the temperature, the metallic conductive layer is desirably thinned to 10 to 100 μm or so. Further, the conveying direction of a medium to be fixed by the fixing apparatus is also optional and an apparatus for conveying vertically a medium to be fixed is acceptable. Further, the temperature sensor kind and response time are not limited.

As described above in detail, according to the present invention, the temperature control of the heating member in real time by the induction heating coil can be executed, so that the power is not consumed unnecessarily and energy conservation of the fixing apparatus can be realized. Further, when reaching the nip, the heating member can be always kept at a fixed fixable temperature, and stable fixing is obtained, and the image quality can be improved by a satisfactory fixing capacity without generating ripple marks on a fixed image.

What is claimed is:

1. A fixing apparatus of an image forming apparatus comprising:

an endless heating member having a metallic conductive layer;

a pressure member pressed to the heating member to form a nip to hold and convey a medium to be fixed having a toner image in a predetermined direction together with the heating member;

an induction heating coil arranged on an outer periphery of the heating member to generate an induced current in the metallic conductive layer; and a temperature sensor to detect a temperature of the endless heating member, wherein the heating member is a heat roller, and the temperature sensor and the induction heating coil are sequentially arranged on a downstream side of the nip in a rotational direction of the heat roller, and when a rotational speed of the heat roller is assumed as S1, and a radius of the heat roller is assumed as r, and a response speed of the temperature sensor is assumed as t, an arrangement position θ(°) of the heat roller centering on a shaft thereof from a detection position on the heat roller by the temperature sensor to a position opposite to an upstream side end of the induction heating coil is set to $\theta(°)>S1\times t\times 360(2\pi r)$.

2. The fixing apparatus of an image forming apparatus according to claim 1, further comprising:

a controller to control the induction heating coil so as to return the heating member to a predetermined temperature before the nip passing area of the heating member next reaches the nip, wherein the controller changes and controls an output value of the induction heating coil according to a difference between detection results by the temperature sensor and the predetermined temperature.

3. The fixing apparatus of an image forming apparatus according to claim 1, wherein the temperature sensor is a non-contact type temperature sensor.

4. The fixing apparatus of an image forming apparatus according to claim 3, wherein the non-contact type temperature sensor measures infrared light generated from the heat roller.

5. The fixing apparatus of an image forming apparatus according to claim 4, wherein a detection position on the heat roller is an intersection point between an optical axis of the non-contact type temperature sensor and the heat roller.

* * * * *